United States Patent [19]

Claus et al.

[11] 4,225,471

[45] Sep. 30, 1980

[54] CLEANING COMPOSITION CONTAINING MINERAL SPIRITS ALKANOLAMIDE, AND OLEYL DIMETHYLAMINE OXIDE

[75] Inventors: Robert T. Claus; William H. Frisz, both of Cincinnati, Ohio

[73] Assignee: Chemed Corporation, Cincinnati, Ohio

[21] Appl. No.: 945,191

[22] Filed: Sep. 25, 1978

Related U.S. Application Data

[63] Continuation-in-part of Ser. No. 788,927, Apr. 19, 1977, abandoned.

[51] Int. Cl.[2] ..... C11D 1/835; C11D 7/50

[52] U.S. Cl. ..... 252/547; 252/153; 252/171; 252/548; 252/DIG. 14; 8/137

[58] Field of Search ..... 252/153, 171, 172, 547, 252/548, DIG. 1, DIG. 14

[56] References Cited

U.S. PATENT DOCUMENTS

| | | | |
|---|---|---|---|
| 2,097,737 | 11/1937 | Pickett et al. | 252/118 |
| 3,086,943 | 4/1963 | Lang | 252/544 |
| 3,202,714 | 8/1965 | Zimmerer et al. | 260/584 |
| 3,342,739 | 9/1967 | Corey et al. | 252/548 |
| 3,507,806 | 4/1970 | Barker et al. | 252/316 |
| 3,634,265 | 1/1972 | Merritt | 252/107 |
| 3,666,668 | 5/1972 | Klausner | 252/90 |
| 3,671,441 | 6/1972 | Dasch | 252/153 |
| 3,737,387 | 6/1973 | Marple | 252/170 |
| 3,764,544 | 10/1973 | Haworth | 252/170 |
| 3,808,311 | 4/1974 | Olson et al. | 424/70 |

FOREIGN PATENT DOCUMENTS

| | | | |
|---|---|---|---|
| 7204495 | 10/1972 | Netherlands | 252/547 |

OTHER PUBLICATIONS

*Pine Oil Formulary,* Hercules, Inc., Wilmington, Del., pp. 1–7, (Sect. A) and 42–44.

*Primary Examiner*—P. E. Willis, Jr.
*Attorney, Agent, or Firm*—Charles L. Harness

[57] ABSTRACT

A novel hydrocarbon containing cleaning composition is used in conjunction with conventional laundry detergents to remove dirt and/or oily deposits from fabrics not ordinarily removable by conventional laundry processes.

3 Claims, No Drawings

CLEANING COMPOSITION CONTAINING MINERAL SPIRITS ALKANOLAMIDE, AND OLEYL DIMETHYLAMINE OXIDE

This is a continuation-in-part of our copending application Ser. No. 788,927 filed Apr. 19, 1977, now abandoned.

This invention relates to a new hydrocarbon based composition and a method of using it in conjunction with conventional laundry detergents, builders or soaps, suitably in conventional laundry apparatus. By the use of this invention stains can be removed from fabrics that were removable in the past only by drycleaning or drycleaning/water wash techniques applied sequentially. By the use of this invention, the herein disclosed composition and cleaning process permits the use of known hydrocarbon solvents which are substantially insoluble in water to be suspended and partially emulsified in a water laundry system. In this dispersion-/emulsified state, these hydrocarbon solvents are made much more available for removal of hydrocarbon and similar soils.

The performance of the herein disclosed composition and process is unusual in that by its use, we have been able to reclaim (i.e., suitably clean) bed linens that had been soiled with nonreactive soils such as baby oil and petroleum jelly. Also using the herein disclosed Composition A in the herein described process, we successfully washed mechanics' uniforms that demonstrably could not be cleaned in water wash systems. (See Table 1, Comparison of Traditional and New Wash Process.)

According to the invention, the fabric is initially treated in a standard laundry apparatus using a hydrocarbon based material, described below, as Composition A.

TABLE 1

Comparison of Traditional and New Wash Process

| | Corn Oil | Used Motor Oil |
|---|---|---|
| Conventional Wash | Fair/Good | Poor |
| Conventional Wash and Laundry Prespotter | Good | Fair |
| New Cleaning Composition and Process | Excellent | Good-Excellent |

Composition A

| | Wt. % | | |
|---|---|---|---|
| | Specific | Preferred | Operable |
| Odorless mineral spirits (soil solvent)[1] | 81 | 75–85 | 25 to 98 |
| Primary or secondary alcohol of 11–15 carbon atoms, ethoxylated with 5 average moles ethylene oxide (surfactant) | 10 | 1–25 | 1.0 to 60 |
| Oil-soluble alkanolamide (emulsifier)[2] | 2 | 1–5 | 0.5 to 15 |
| Alkenyl dialkylamine oxide (water-soluble emulsifier[3] | 2 | 1–5 | 0.5 to 20 |
| Pine oil (soil solvent) | 5 | 2–25 | 0 to 90 |

-continued

Composition A

| | Wt. % | | |
|---|---|---|---|
| | Specific | Preferred | Operable |
| | 100 | | |

[1]A hydrocarbon, typically distilling 354°–400° F. at 760 mm Hg; closed cup flash point, 131° ± 3° F.

[2]The alkanolamide of this invention has the formula

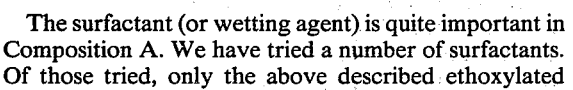

where $R_1$ = H or methyl
m = 1 or 2
n = 2 − m
$R_2 = C_xH_{2x+1}$ or $C_xH_{2x-1}$,
where x is 10–18 and is preferably oleic diethanolamide, made by reacting 3–4 moles diethanolamine with 1 mole oleic acid, commercially available.

The amine oxide of this invention has the formula

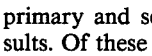

where $R_1$ and $R_2$ are independently of the formula $C_nH_{2n+1}$ and $R_3$ has the formula $C_nH_{2n+1}$ or $C_nH_{2n-}$, where n is 1–18. Preferably $R_1$ and $R_2$ are methyl and $R_3$ is oleyl, i.e., oleyl dimethyl amine oxide, commercially available.

The surfactant (or wetting agent) is quite important in Composition A. We have tried a number of surfactants. Of those tried, only the above described ethoxylated primary and secondary alcohols gave really good results. Of these two, the latter gave the better results.

The cleaning process requires at one stage, the use of a conventional laundry detergent, builders, or soap. This part of the invention is by no means critical, and any and/or commercial laundry detergent, builder or builders or soaps, can be used. However, for convenience, a typical conventional laundry detergent is given as follows:

LAUNDRY DETERGENT

| | Wt. % |
|---|---|
| Soda ash, natural dense | 27.5 |
| Optical brightener[1] | 0.2 |
| Sodium carboxymethylcellulose | 1.0 |
| Sodium tripolyphosphate | 27.0 |
| Sodium metasilicate, anhydrous | 12.8 |
| Sodium dodecylbenzene sulfonate | 2.0 |
| Non-ionic detergent, alkanol, ethoxylated with 40 moles ethylene oxide | 8.0 |
| Sodium sulfate | 21.5 |
| | 100.0 |

[1]Commercially available as Tinopal AMS from Ciba-Geigy Corp. Numerous suitable optical brighteners are commercially available, and the type is not critical. A typical optical brightener for laundry use is made by diazotization of 4-aminostilbene-2-sulfonic acid, followed by coupling with e.g., a naphthylamine derivative, and oxidation to the triazole compound.

The aforesaid Composition A (as defined in the "Specific" column) and laundry detergent are used in the cleaning process of this invention. The odorless mineral spirits was the hydrocarbon stated in Footnote 1 to Composition A; the alkanolamide was oleic diethanolamide, and the amine oxide was oleyl dimethyl amine exide. This process is set forth in detail as follows, together with a statement of some differences of traditional methods.

CLEANING PROCESS

Traditional methods of cleaning fabric containing hydrophobic soils and mixtures of hydrophobic and various other soils have involved either a pretreatment with a solvent-based "pre-spotter" or addition of said "pre-spotter" to the wash machine. However, the solvents in these processes are not allowed intimate contact with the fabric due to the partitioning of water and solvent in the washer.

This invention allows for the unique penetration of the solvents via an emulsion into soiled fabric to loosen and facilitate the removal of the hydrophobic soils and mixtures of hydrophobic and various other soils. The emulsified state permits intimate contact of said cleaning component system and the soils described above.

The cleaning process is particularly effective in cleaning the newer synthetic fabrics, such as all polyester and polyester/cotton blends. This has been of primary importance due to the affinity of polyester and other petroleum-derived fibers for oily and greasy soils. These soils have been previously very difficult, if not impossible, to remove from the synthetic fabrics using conventional water wash treatments.

The cleaning process essentially is an emulsion treatment of the soiled fabric with the aforementioned cleaning Composition A followed by washing with conventional water wash techniques.

The emulsion treatment involves filling any conventional water wash laundry machine with just enough water to thoroughly wet the soiled items. The cleaning Composition A is then introduced at between 1 part Composition A to 10–75 parts water, preferably at 1 part of cleaning Composition A and 20 to 30 parts water. (An emulsion will form.)

The soiled items are agitated in the emulsion so formed for a period of time between two to thirty minutes, and preferably ten minutes.

The next phase of the invention involves raising the water level to achieve a 1:30 to 1:90 product-water ratio, preferably a 1:60 dilution. This is done by not draining the 1:30 emulsion, but by adding hot (140°–160° F.) water to the first emulsion treatment phase. Conventional laundry detergents can be added from just prior to filling the machine to said wash level until just after filling. This second phase is allowed to agitate in the machine for three to thirty minutes, preferably seven to fifteen minutes. This bath is then drained and followed by conventional wash programs. See Table 2, TYPICAL EXAMPLE OF WASH PROCESS, below.

TABLE 2

| | TYPICAL EXAMPLE OF WASH PROCESS | | | |
|---|---|---|---|---|
| FUNCTION | TIME | LEVEL | TEMPERATURE | SUPPLIES |
| Water Emulsion Treatment | 10 min. | Very low | Warm 65°–140° F. | Composition A |
| Detergent/ Water Emulsion Treatment | 10 min. | Low | Warm-hot 140°–160° F. | Composition A and Conventional Laundry Detergents, Builders, or Soap |
| Drain | 1 min. | — | — | — |
| Detergent Treatment | 8–12 min. | Low | Warm-hot 140°–160° F. | Conventional Laundry Detergents, Builders, or Soap |
| Drain | 1 min. | — | — | — |
| Rinse | 2 min. | High | Warm-hot 120°–140° F. | — |
| Drain | 1 min. | — | — | — |
| Rinse | 2 min. | High | Warm 110°–130° F. | — |

In the final step the rinse liquid is drained from the fabric.

In our composition above, pine oil is mentioned as preferably included. Pine oil removes certain soils better than mineral spirits, e.g., resins and higher molecular weight synthetic and natural polymers. If such soils are absent, pine oil may be omitted.

What is claimed is:

1. Composition of matter consisting essentially of:

| | Wt. % |
|---|---|
| (1) Odorless mineral spirits | 25–98 |
| (2) Primary or secondary alcohol of 11–15 carbon atoms, ethoxylated with 5 average moles of ethylene oxide, and mixtures thereof | 1–60 |
| (3) Oil-soluble alkanolamide of the formula $\left(HO\overset{H}{\underset{R_1}{C}}CH_2\right)_m \overset{Hn}{\underset{O}{\overset{\|}{N}}}CR_2$ where $R_1$ = H or methyl, m = 1 or 2, n = 2 − m, $R_2 = C_xH_{2x+1}$ or $C_xH_{2x-1}$, where x is 10–18 | 0.5–15 |
| (4) Oleyl dimethylamine oxide | .5–20 |
| (5) Pine oil | 0–90 |

2. Composition of matter according to claim 1 consisting essentially of the said respective five components, as follows:

| | Wt. % |
|---|---|
| (1) Odorless mineral spirits | 78–85 |
| (2) Ethoxylated alcohol | 1–25 |
| (3) Alkanolamide | 1–5 |
| (4) [Alkenyl dialkylamine] Oleyl dimethylamine oxide | 1–5 |
| (5) Pine oil | 2–25 |

3. Composition of matter according to claim 1 consisting essentially of the said respective five components, as follows:

| | Wt. % |
|---|---|
| (1) Odorless mineral spirits, being hydrocarbon, distilling 354°–400° F. at 760 mm Hg; closed cup flash point, 131° ± 3° F. | 81 |
| (2) Secondary alcohol of 11–15 carbon atoms, ethoxylated with 5 average moles of ethylene oxide | 10 |
| (3) Oleic diethanolamide | 2 |
| (4) Oleyl dimethylamine oxide | 2 |
| (5) Pine Oil | 5 |

* * * * *